United States Patent [19]

Allen

[11] Patent Number: 4,648,741

[45] **Date of Patent: * Mar. 10, 1987**

[54] VIBRATORY SCREED INCLUDING A SPREADING DEVICE FOR LEVELING AND DISTRIBUTING PLASTIC CONCRETE IN FRONT OF THE SCREED

[76] Inventor: J. Dewayne Allen, 208 N. 7th St., Paragould, Ark. 72450

[ * ] Notice: The portion of the term of this patent subsequent to Aug. 21, 2001 has been disclaimed.

[21] Appl. No.: 704,339

[22] Filed: Feb. 22, 1985

Related U.S. Application Data

[63] Continuation-in-part of Ser. No. 598,662, Apr. 10, 1984, abandoned, which is a continuation of Ser. No. 457,727, Jan. 13, 1983, Pat. No. 4,466,757.

[51] Int. Cl.[4] ..... E01C 19/22; E01C 19/30

[52] U.S. Cl. ..... 404/119; 404/120; 404/114

[58] Field of Search ..... 404/101, 102, 105, 106, 404/113-115, 118-120

[56] References Cited

U.S. PATENT DOCUMENTS

| | | | |
|---|---|---|---|
| 1,840,970 | 1/1932 | Noble | 404/102 |
| 2,006,316 | 6/1935 | Mandt | 404/101 |
| 2,346,379 | 4/1944 | Jackson | 404/102 X |
| 2,380,435 | 7/1945 | Heltzel | 404/102 |
| 2,439,620 | 4/1948 | Faber | 404/101 |
| 2,757,588 | 8/1956 | Pollitz | 404/114 |
| 3,262,378 | 7/1966 | Schrimper et al. | 404/120 |
| 3,540,360 | 11/1970 | Snow et al. | 404/120 X |
| 3,883,259 | 5/1975 | Berg et al. | 404/120 |
| 4,068,970 | 1/1978 | Rowe | 404/101 X |
| 4,466,757 | 8/1984 | Allen | 404/114 |

*Primary Examiner*—James A. Leppink
*Assistant Examiner*—John F. Letchford
*Attorney, Agent, or Firm*—Cahill, Sutton & Thomas

[57] ABSTRACT

A vibratory concrete screed includes a frame and a substantially horizontal screed blade. A pair of end-mounted winches advance the screed along concrete forms into an area of unfinished plastic concrete. A concrete spreading device is translated back and forth along the length of the screed to partially level the unfinished concrete before engagement by the screed blade. The concrete spreading device includes grading means having distributing means in the form of an auger and metering means in the form of a plow. The auger initially levels and redistributes the plastic concrete while the plow receives the plastic concrete from the trailing edge of the auger and regulates the level of plastic concrete discharged from the concrete spreading device and intercepted by the screed blade. A carriage maintains the grading means at a predetermined elevation in front of the screed blade and translates the spreading device along the length of the screed frame. The concrete spreading device operates on the unfinished plastic concrete to feed a partially finished, constant height charge of concrete to the screed blade.

10 Claims, 46 Drawing Figures

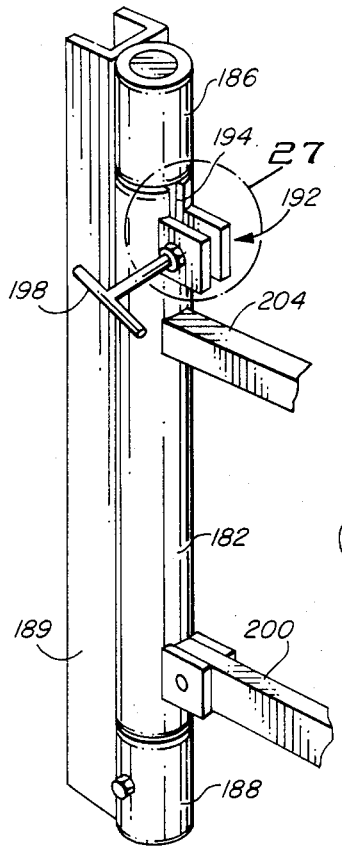
FIG. 26
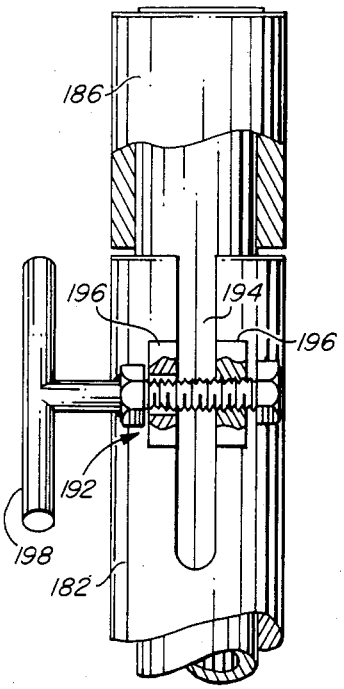
FIG. 27
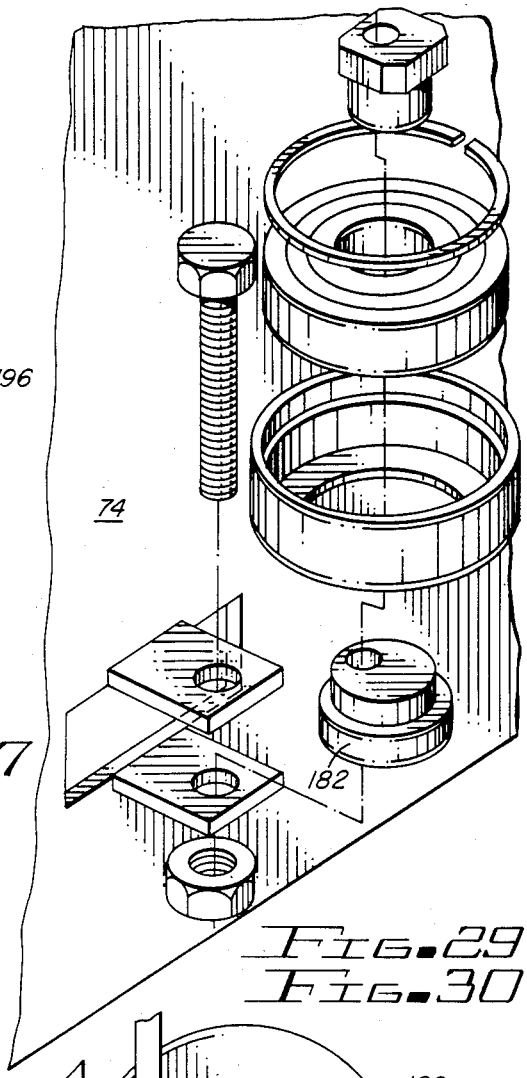
FIG. 29
FIG. 30
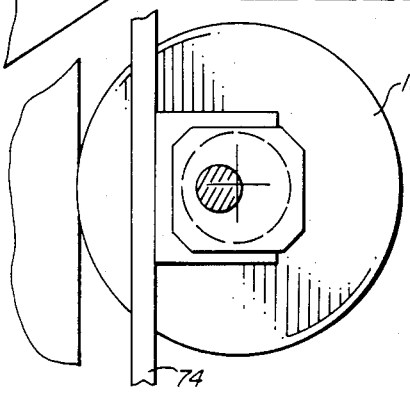
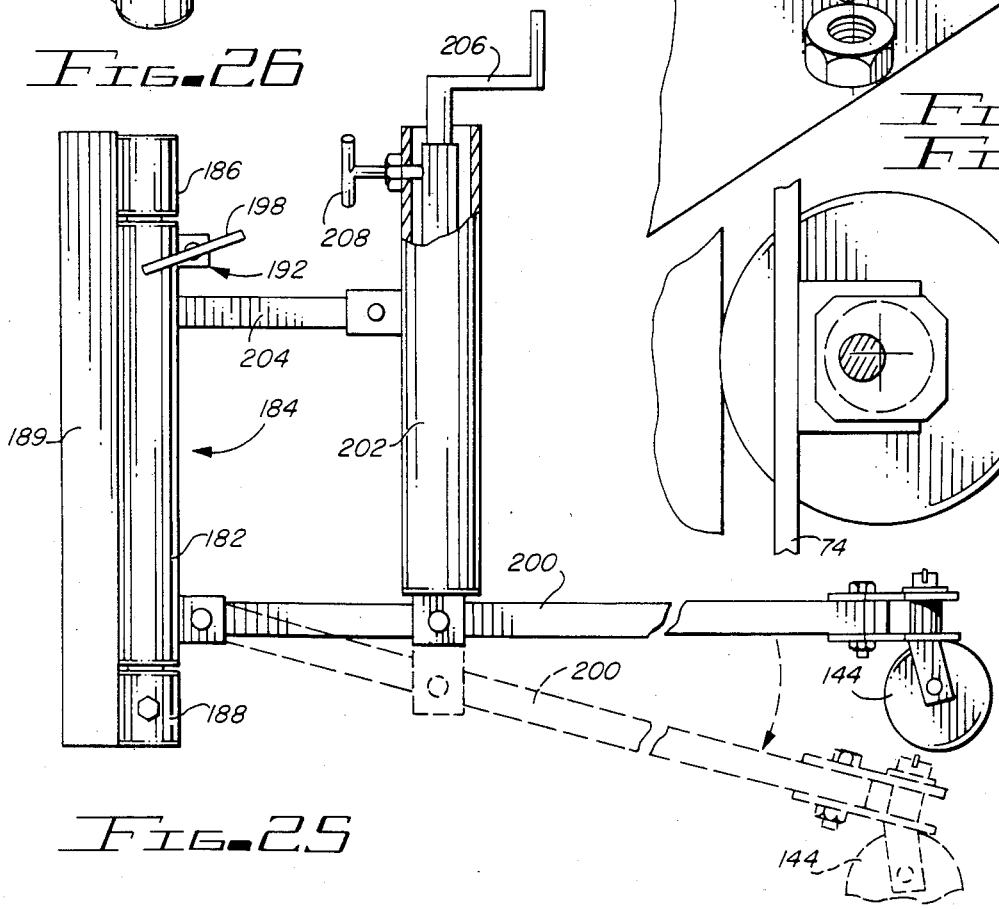
FIG. 25

332
334
336
338
340
342
344
346
348
350
352
354
356
358
330
16
39

VIBRATORY SCREED INCLUDING A SPREADING DEVICE FOR LEVELING AND DISTRIBUTING PLASTIC CONCRETE IN FRONT OF THE SCREED

This is a Continuation-in-Part application of U.S. patent application Ser. No. 598,662, filed Apr. 10, 1984, now abandoned, which is a Continuation patent application of Ser. No. 457,727 filed on Jan. 13, 1983, now U.S. Pat. No. 4,466,757.

BACKGROUND OF THE INVENTION

1. Field of the Invention

This invention relates to vibratory concrete screeds, and more particularly, to vibratory concrete screeds which include a laterally translatable concrete spreading device positioned in front of the screed blade to partially level and distribute plastic concrete before the screed blade engages the concrete.

2. Description of the Prior Art

The relevant prior art is identified in U.S. Pat. No. 4,466,757 issued on Aug. 21, 1984, the disclosure of which is hereby incorporated by reference.

SUMMARY OF THE INVENTION

U.S. Pat. No. 4,466,757 discloses a preferred embodiment of the invention including grading means in the form of a rotating auger. In that embodiment of the invention, the partially levelled, redistributed plastic concrete exits the trailing edge of the auger and is immediately intercepted by the advancing front blade of the screed. One improvement of that invention is disclosed and claimed herein and includes metering means which forms a part of the grading means of the present invention. The metering means receives the partially levelled plastic concrete from the distributing means which forms the initial portion of the grading means. The metering means functions to regulate the height of the charge of plastic concrete discharged from the concrete spreading means and intercepted by the screed blade. This improved grading means including both distributing means and metering means sequentially operates on the unfinished plastic concrete to feed a partially finished, constant height charge of concrete to the screed blade as the carriage means of the present invention translates the grading means in first and second directions along the length of the screed frame.

U.S. Pat. No. 4,466,757 also discloses an oscillating strike-off concrete finishing mechanism which is coupled to a screed frame in front of the front screed blade. The oscillating strike-off is either coupled between the concrete spreading means and the front screed blade and operates as an intermediate finishing device or may be coupled in a similar position to a screed which does not include concrete spreading means. The improved oscillating strike-off disclosed herein includes means for adjusting the vertical spacing between the oscillating strike-off blade and the screed blade. When used as a concrete finishing device without the concrete spreading means of the present invention, a plurality of spaced apart pneumatic vibrators may be mounted directly on the oscillating strike-off blade to improve the concrete finishing capabilities.

The improved invention disclosed herein also includes a paving train consisting of a primary finishing screed including concrete spreading means followed in spaced apart relationship by a secondary finishing screed including an oscillating strike-off.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

FIGS. 1–30 are included in U.S. Pat. No. 4,466,757 and relate to earlier embodiments of the present invention.

DESCRIPTION OF THE PREFERRED EMBODIMENT

In order to better illustrate the advantages of the invention and its contributions of the art, a preferred hardware embodiment of the invention will now be described in detail.

Figure 1:
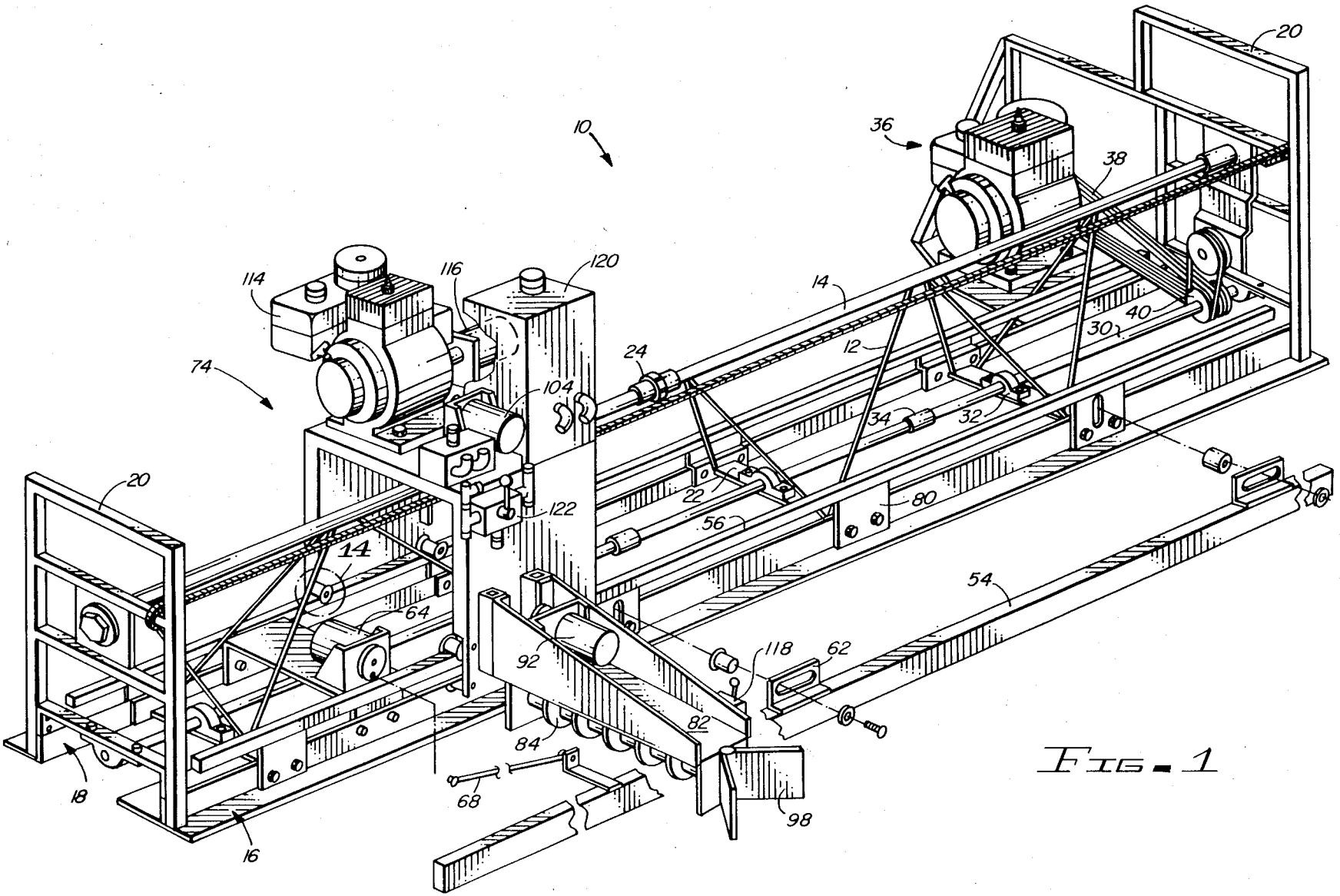
Figure 2:
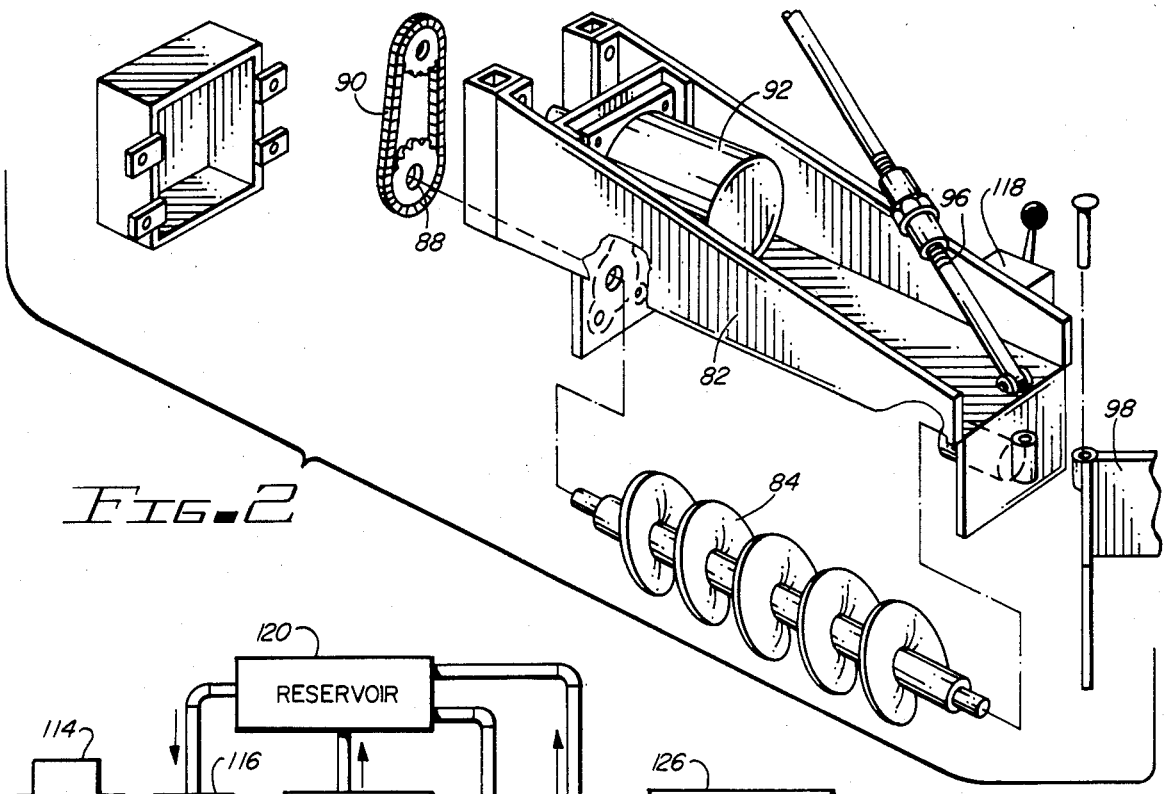
Figure 3:
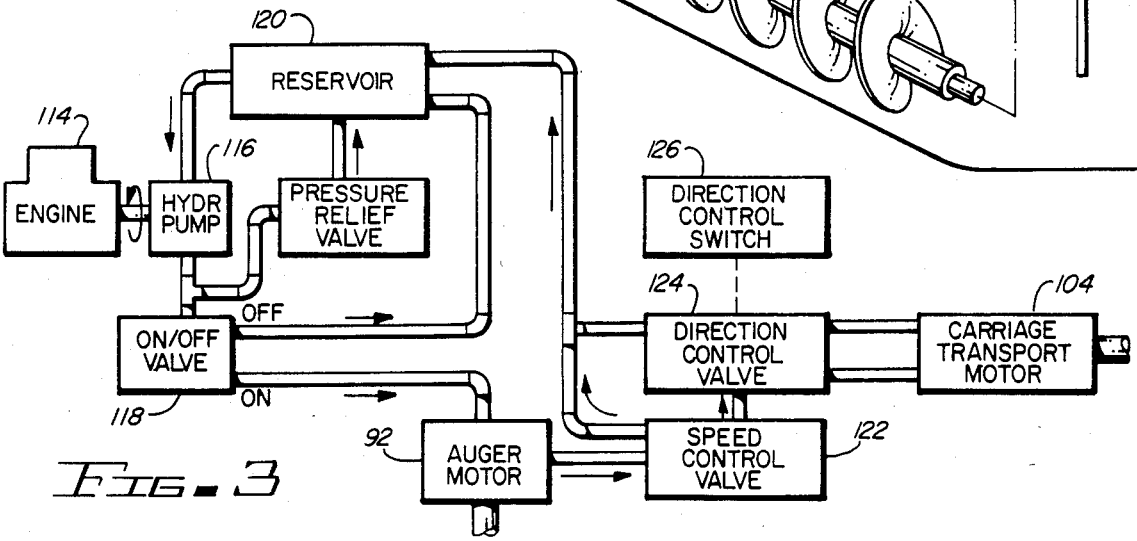
Figure 17:
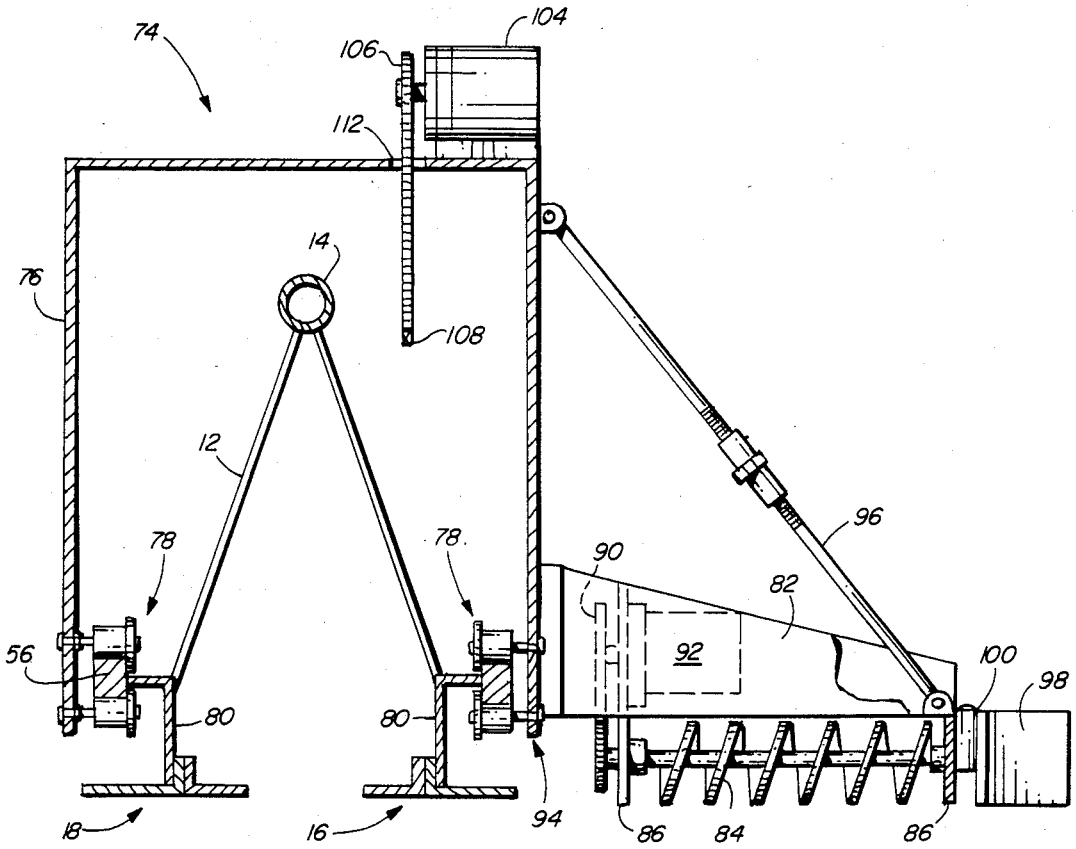
Figure 18:
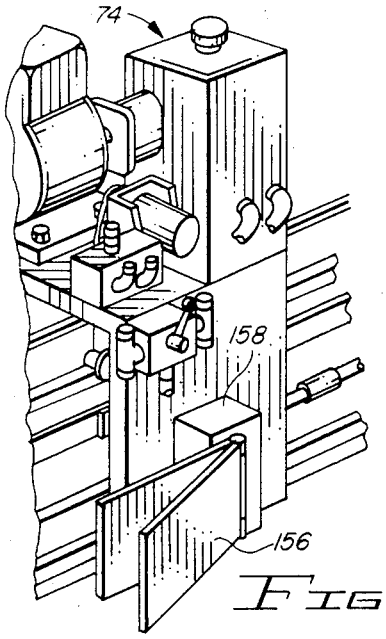
Figure 19:
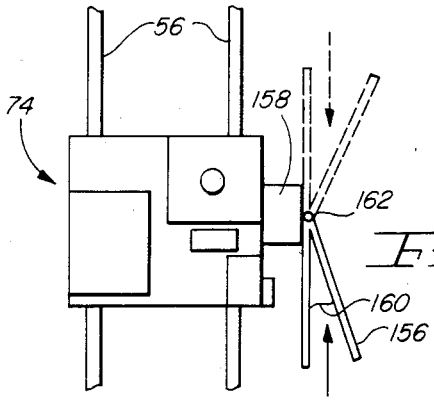
Figure 20:
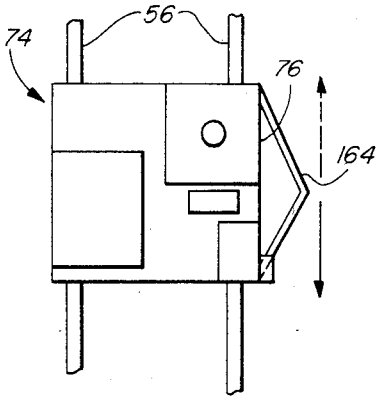
Figure 21:
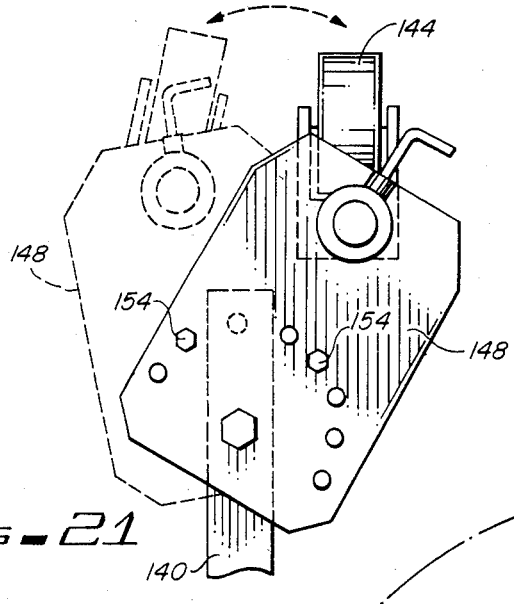
Figure 22:
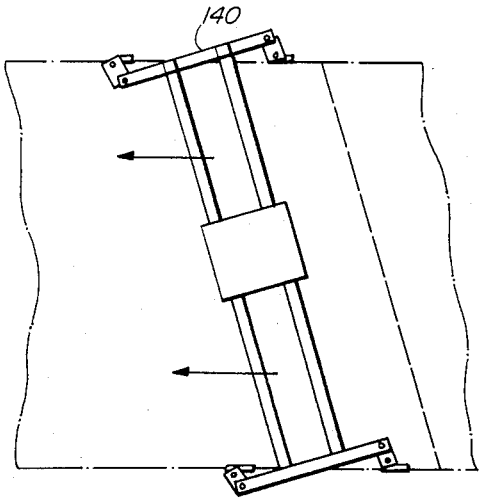
Figure 23:
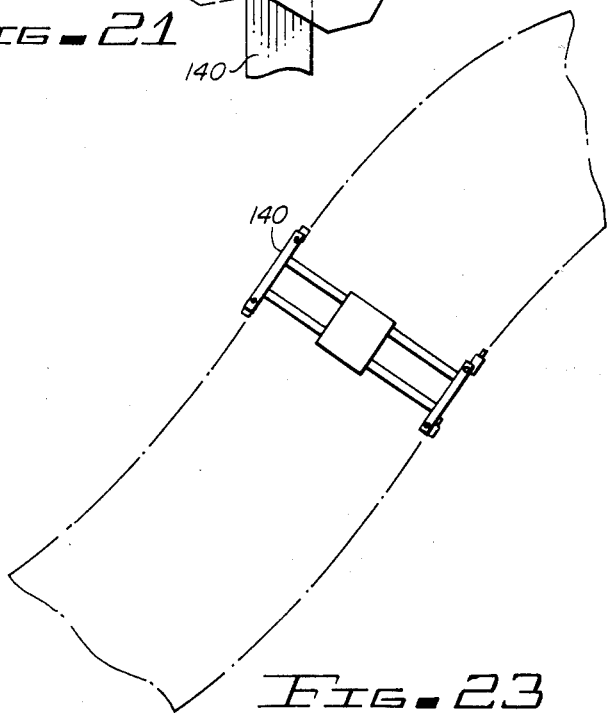
Figures 24, 28:
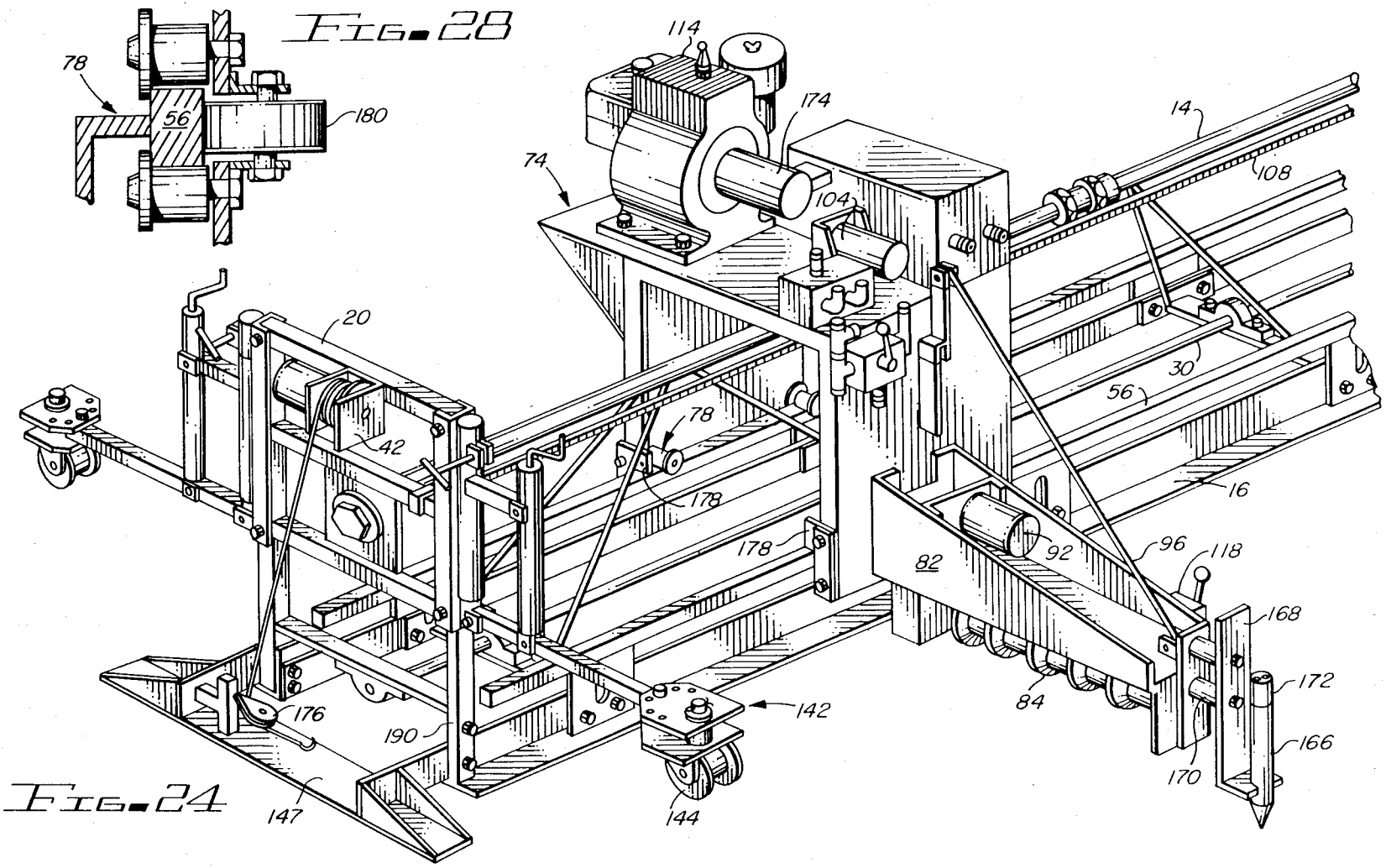
Figure 31A:
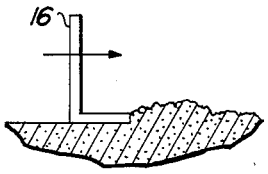
FIGS. 31A–D illustrate the excessive build-up of plastic concrete on the blade of a vibrating screed which receives an excessive charge height of plastic concrete.
Figure 31B:
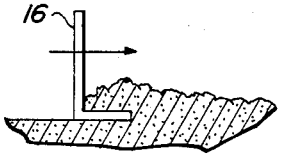
Figure 31C:
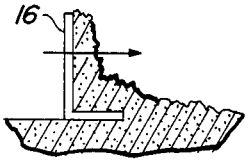
Figure 31D:
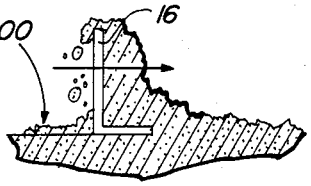
Figure 32:
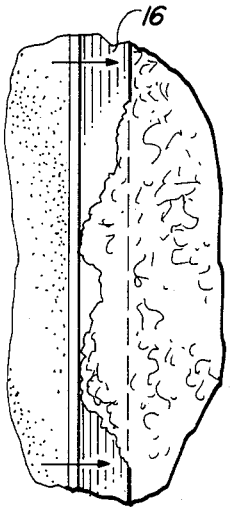
FIG. 32 (PRIOR ART)
FIG. 32 is a view from above of the blade spill-over problem illustrated in FIG. 31.

The preferred embodiment of the initial version of the invention is fully disclosed in U.S. Pat. No. 4,466,757 which is hereby incorporated by reference. In certain circumstances, that initial embodiment of the invention encountered blade spill over problems of the type illustrated in FIGS. 31 and 32. In the embodiment of the invention as illustrated in FIGS. 1 and 17, the trailing edge of auger 84 was immovably secured to carriage 76 precluding relative vertical adjustments between the trailing edge of auger 84 and front screed blade 16. As the screed advanced forward into an area of unfinished plastic concrete, concrete could spill over the top of screed blade 16 disturbing the finished concrete surface designated by reference number 300 as illustrated in FIG. 31D.

Figure 33:
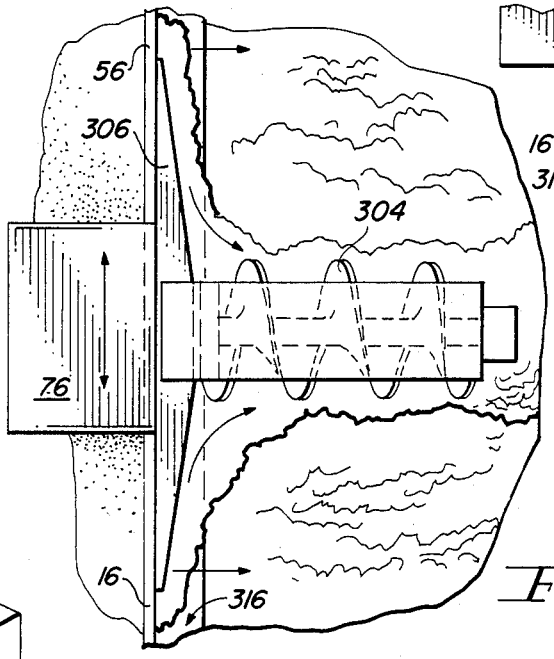
FIG. 33 is a view from above illustrating the metering means of the present invention coupled to the concrete spreading means.
Figure 34:
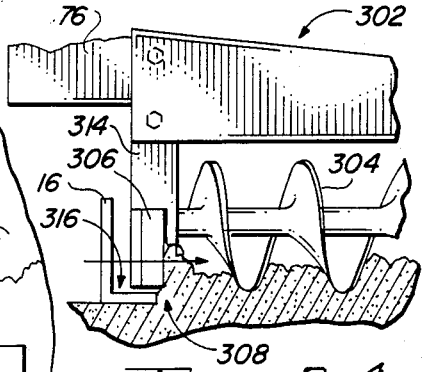
FIG. 34 illustrates the relative position of the metering means of the present invention with respect to the front screed blade and the distributing means of the present invention.
Figure 35:
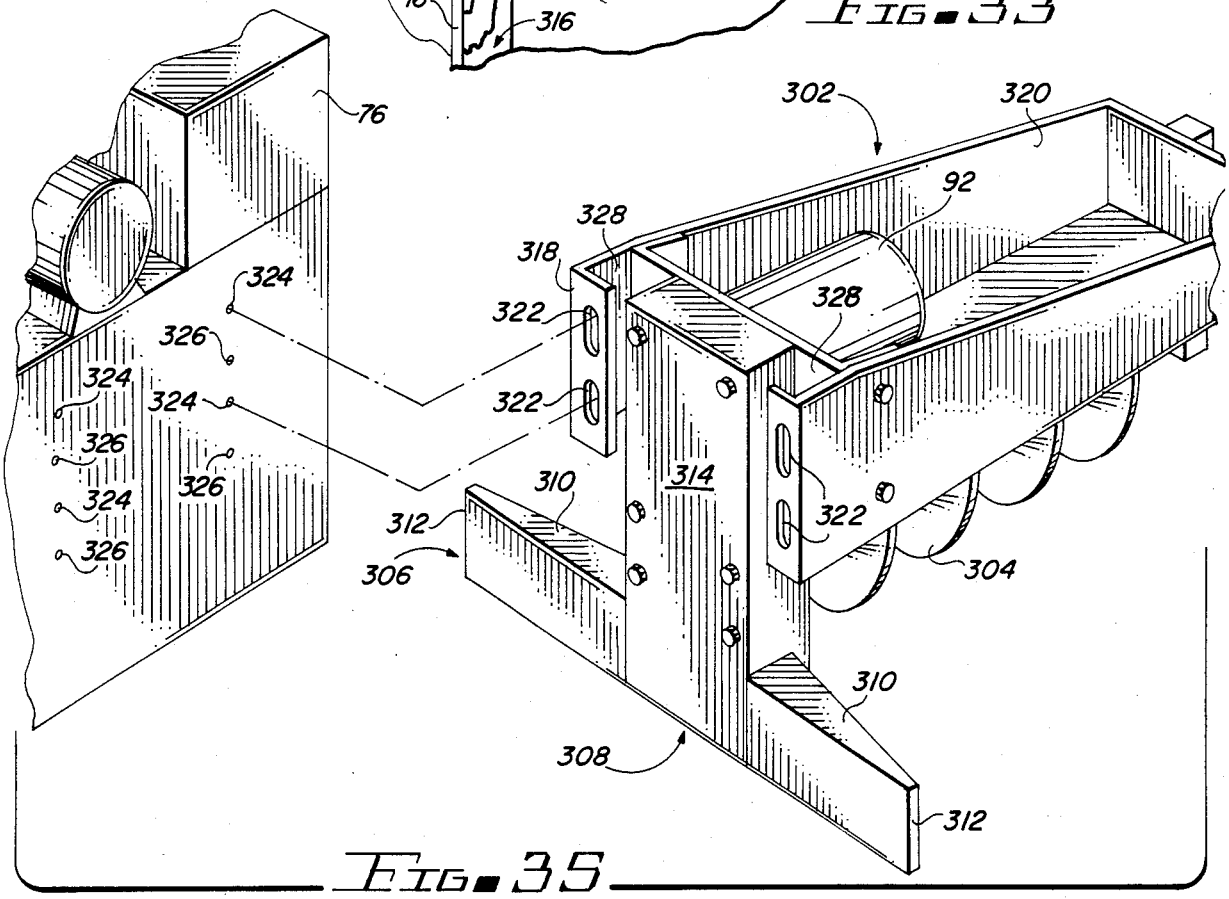
FIG. 35 depicts the grading means detached from the carriage means of the present invention to illustrate structure permitting relative vertical adjustment between the grading means and the carriage means.

In order to overcome this problem, the structure illustrated in FIGS. 33–35 has been created. The grading means 302 of the present invention has now been improved to incorporate distributing means and metering means. In the depicted preferred embodiment of the invention, the distributing means takes the form of an auger 304 and the metering means takes the form of a plow 306. Plow 306 includes a horizontally oriented, continuous lower surface 308 joining together a pair of wedge-shaped end sections 310 which each include a vertically oriented cutting edge 312. Plow 306 is coupled to the horizontally oriented lower surface of chain box 314 which houses the drive chain coupling auger drive motor 92 to auger 304.

To optimize operation of the metering means of the present invention, vertical adjustment means is provided to permit precise adjustment of the spacing between the lower surface 308 of plow 306 and the horizontally oriented surface 316 of front screed blade 16. The inner face 318 of auger support bracket 320 includes four spaced-apart, vertically oriented oval apertures 322 which may be mated with either an upper group 324 or a lower group 326 of apertures in the face of auger carriage 76. A set of four bolts (not shown) are inserted through vertically oriented channels 328, through each of the oval apertures 322 and into either the upper or lower group of apertures 324 or 326 as necessary to achieve the desired spacing between the lower surface 308 of plow 306 and the upper surface 316 of front screed blade 316. When the appropriate vertical spacing has been achieved, each of the four spaced apart mounting bolts is tightened to maintain auger support bracket 320, auger 304 and plow 306 in the desired vertical position. For example, for low slump concrete including one and one-half inch stones, the spacing between the lower surface 308 of plow 306 and the upper surface 316 of blade 16 might be adjusted to approximately one and one-fourth inches. For higher slump concrete, the distance between the plow and the screed blade is typically decreased. The particular plow/screed blade vertical spacing which optimizes performance of the present invention with any particular type of plastic concrete can be readily determined by persons of ordinary skill in the art.

In operation, the metering means of the present invention, including both plow 306 and the above-described vertical adjustment means, is translated back and forth along the length of the screed and as illustrated in FIGS. 33 and 34 intercepts and moves plastic concrete forward into the trailing edge of auger 304. The rotating blade of auger 304 intercepts and moves the plastic concrete forward and laterally redistributes it to produce a substantially level surface. In addition, the metering means of the present invention regulates the charge height of plastic concrete fed to the advancing screed blade 16 by stripping off and moving forward excess height plastic concrete into the trailing edge of auger 304. The elevation of the lower surface 308 of plow 306 determines the charge height of the plastic concrete fed to screed blade 16. The interrelated operation of the distributing means and metering means of the present invention feeds a partially finished, constant height charge of concrete to screed blade 16 as the carriage 76 translates the grading means of the present invention back and forth along the length of the screed frame as the screed simultaneously advances into the unfinished plastic concrete.

Figure 36:
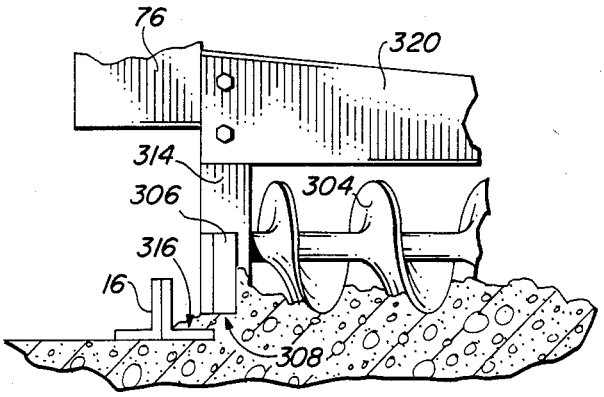
FIG. 36 illustrates the grading means of the present invention including both distributing means and metering means and its relative position with respect to a front screed blade having both forward and rear facing blade sections.
Figure 37:
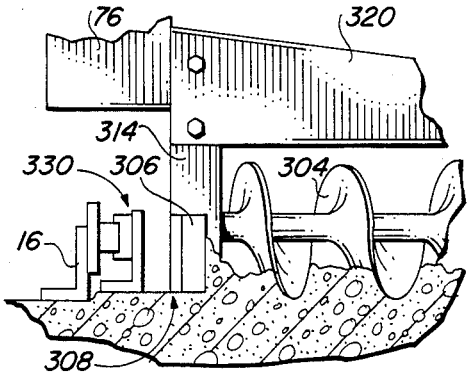
FIG. 37 illustrates the grading means of the present invention including both distributing means and metering means with an oscillating strike-off positioned between the grading means and the screed blade.

FIG. 34 depicts the concrete spreading means of the present invention operating in connection with a single forward-facing screed blade 16. As indicated, the spacing between the lower surface 308 of plow 306 and the upper surface 316 of screed blade 16 may be made quite small. In FIG. 36, screed blade 16 includes both forward facing and rear facing L-shaped blade elements while the spacing between the lower surface 308 of plow 306 and the upper surface 316 of blade 16 has been increased to a distance slightly less than the concrete stone size. The rear edge of plow 306 is situated approximately halfway between the front and rear edges of the front L-shaped section of screed blade 16. In FIG. 37, screed blade 16 includes only a single, rear facing L-shaped blade section and an oscillating strike-off 330 has been coupled to the screed frame between the rear surface of plow 306 and the front surface of screed blade 16. In the particular embodiment illustrated in FIG. 37, the lower blade surface of oscillating strike-off 330 is positioned slightly above the lower surface of screed blade 16 and approximately even with the lower surface 308 of plow 306. In operation, the laterally reciprocating motion of oscillating strike-off 330 accomplishes an intermediate consolidating and finishing operation on the partially finished plastic concrete discharged from the trailing edge of the grading means of the present invention before the plastic concrete is intercepted by screed blade 16. The differential elevation between the lower surface of oscillating strike-off blade 330 and the lower surface of screed blade 16 may be controlled to regulate the height of the charge of plastic concrete fed to screed blade 16. In practice, the lower surface of the blade of oscillating strike-off 330 will typically be adjusted to be even with the lower surface of screed blade 16 or as high as approximately ⅜ of an inch above the lower surface of screed blade 16. Proper adjustment of the oscillating strike-off 330/screed blade 16 height differential can be regulated by a person of ordinary skill in the art to achieve the desired concrete finishing characteristics.

Figures 38, 39, 40:
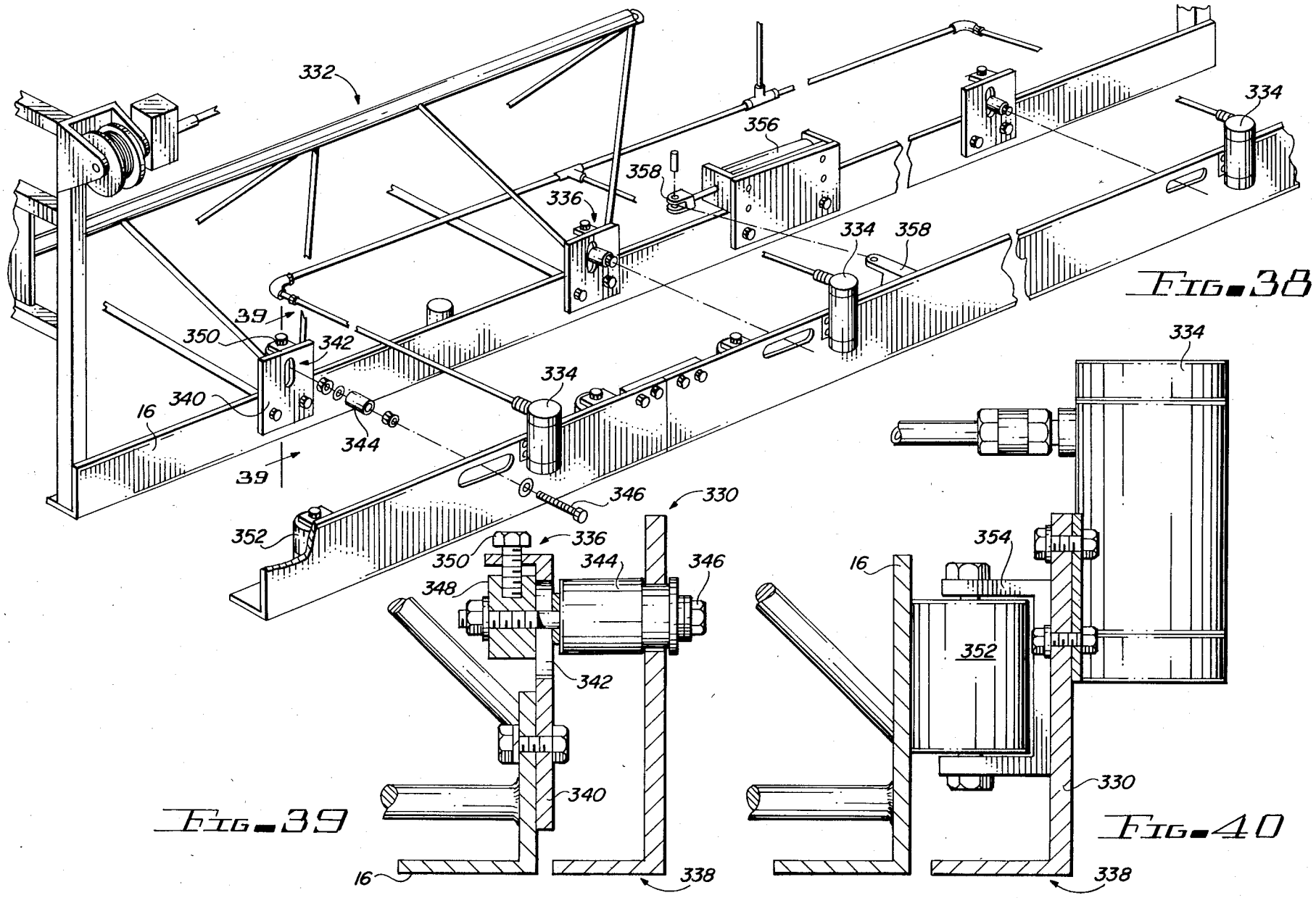
FIG. 38 illustrates the improved oscillating strike-off including vertical strike-off blade adjustment means and a plurality of pneumatic vibrators coupled to the strike-off blade.
FIG. 39 is a sectional view of the oscillating strike-off support structure depicted in FIG. 38, taken along section line 39—39, particularly illustrating the structure which couples the oscillating strike-off blade to the screed.
FIG. 40 represents a sectional view of the oscillating strike-off illustrated in FIG. 38, particularly depicting the roller structure which maintains a predetermined fixed spacing between the oscillating strike-off blade and the screed blade.

Referring now to FIGS. 38–40, screed 332 includes an oscillating strike-off 330 having both a plurality of pneumatically powered, high frequency air vibrators 334 as well as vertical blade adjustment means 336 for controlling the height differential between the lower surface 338 of the oscillating strike-off 330 and the lower surface of screed blade 16. FIGS. 38 and 39 illustrate the structure of vertical blade adjustment means 336.

A plurality of vertically oriented brackets 340 are coupled to the vertically oriented face of screed blade 16 and include a centrally located, vertically oriented oval aperture 342 for accommodating vertical adjustments of oscillating strike-off blade support units 344. A bolt 346 extends through the various elements of support unit 344 and is secured to a vertical adjustment clamp 348 which interfaces with the rear surface of bracket 340. When bolt 346 is loosened, the rotation of bolt 350 regulates the vertical position of strike-off support unit 344 with respect to bracket 340 to control the relative elevation of the lower surface 338 of oscillating strike-off unit 330 with respect to the lower surface of screed blade 316.

As illustrated by FIGS. 38 and 40, a plurality of spaced apart rollers 352 are coupled by brackets 354 to the interior face of the blade of oscillating strike-off 330. The comparatively long rolling interface between rollers 352 and the vertical face of screed blade 16 maintains the blade of oscillating strike-off 330 parallel to the vertical face of screed blade 16 as the screed is advanced into the unfinished plastic concrete.

Figure 4:
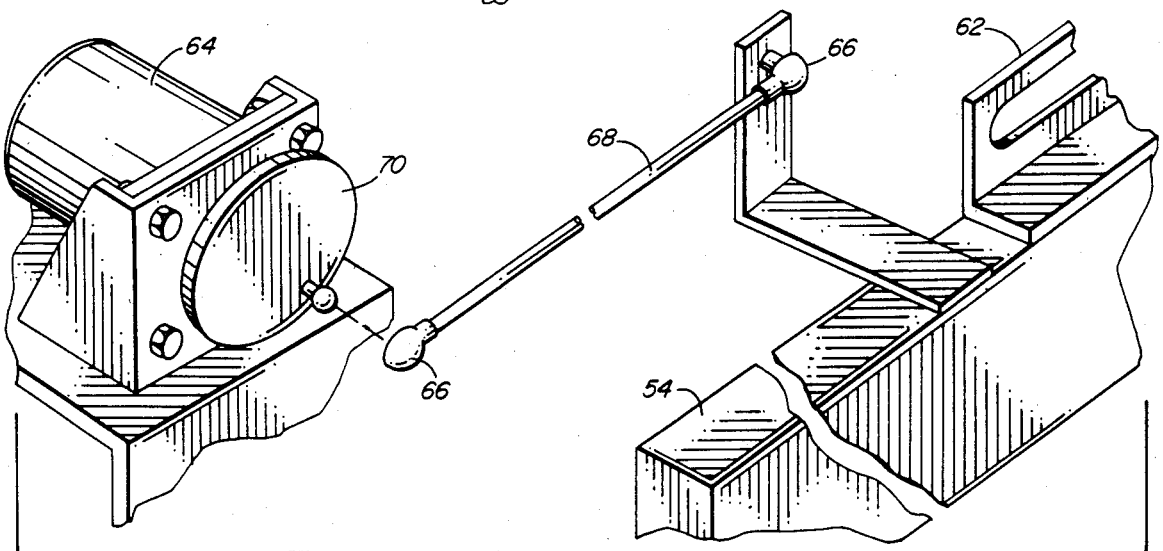
Figure 5:
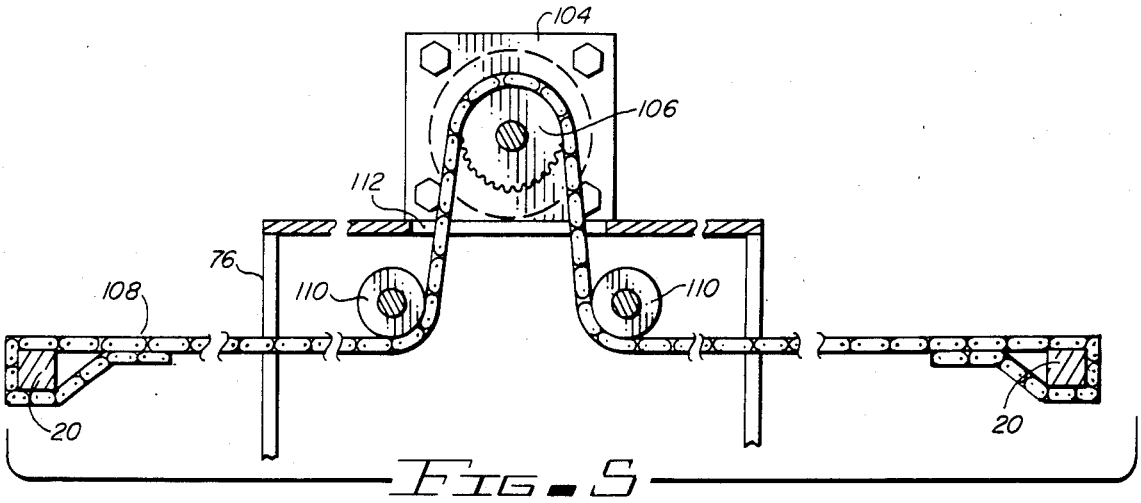
Figure 6:
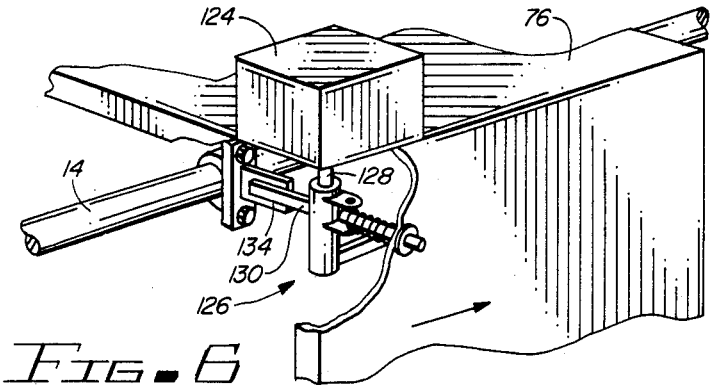
Figure 9:
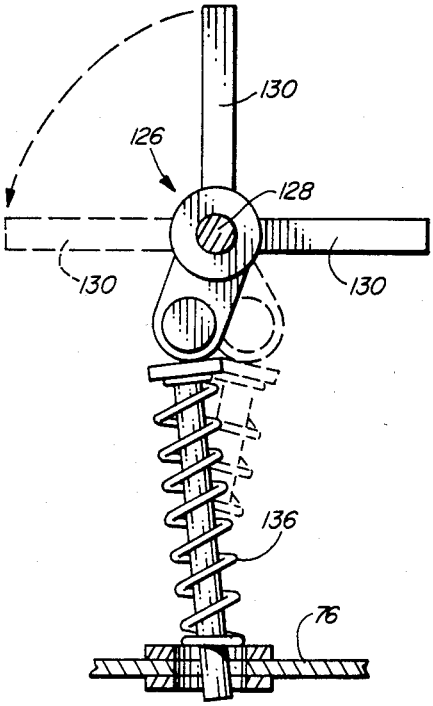
Figure 7:
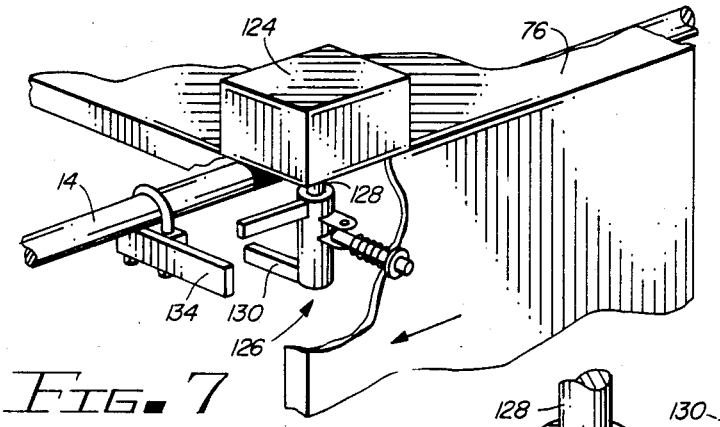
Figure 8:
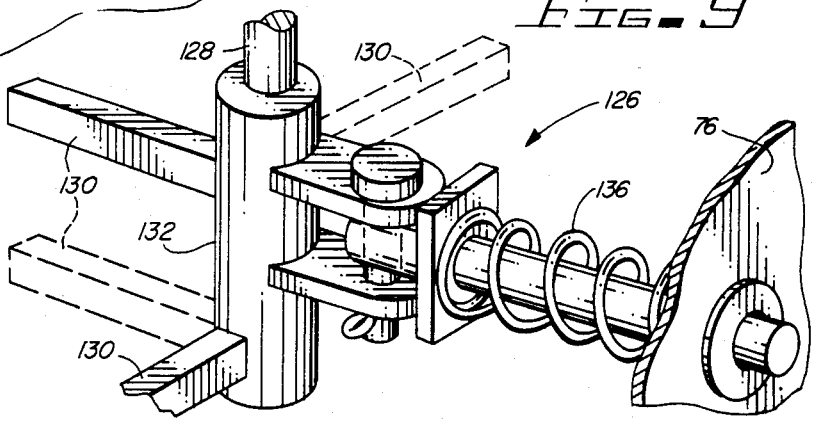
Figure 10:
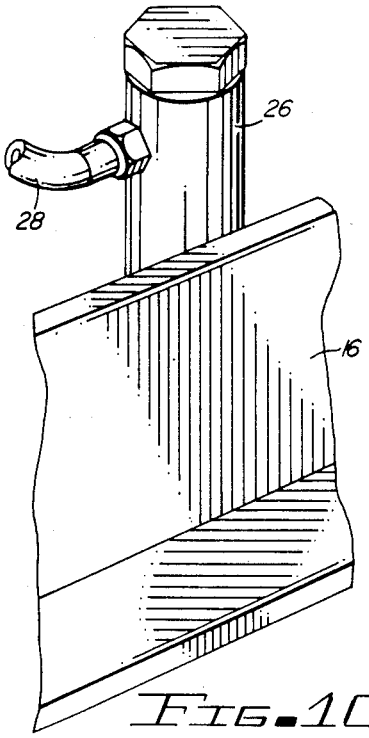
Figure 12:
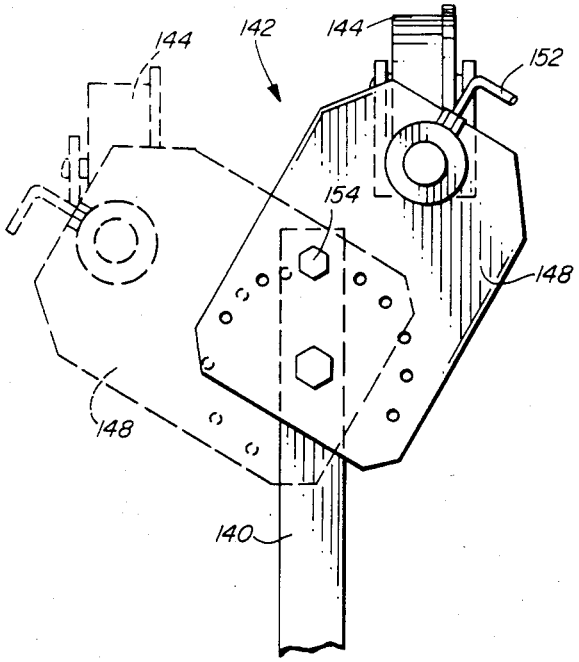
Figure 11:
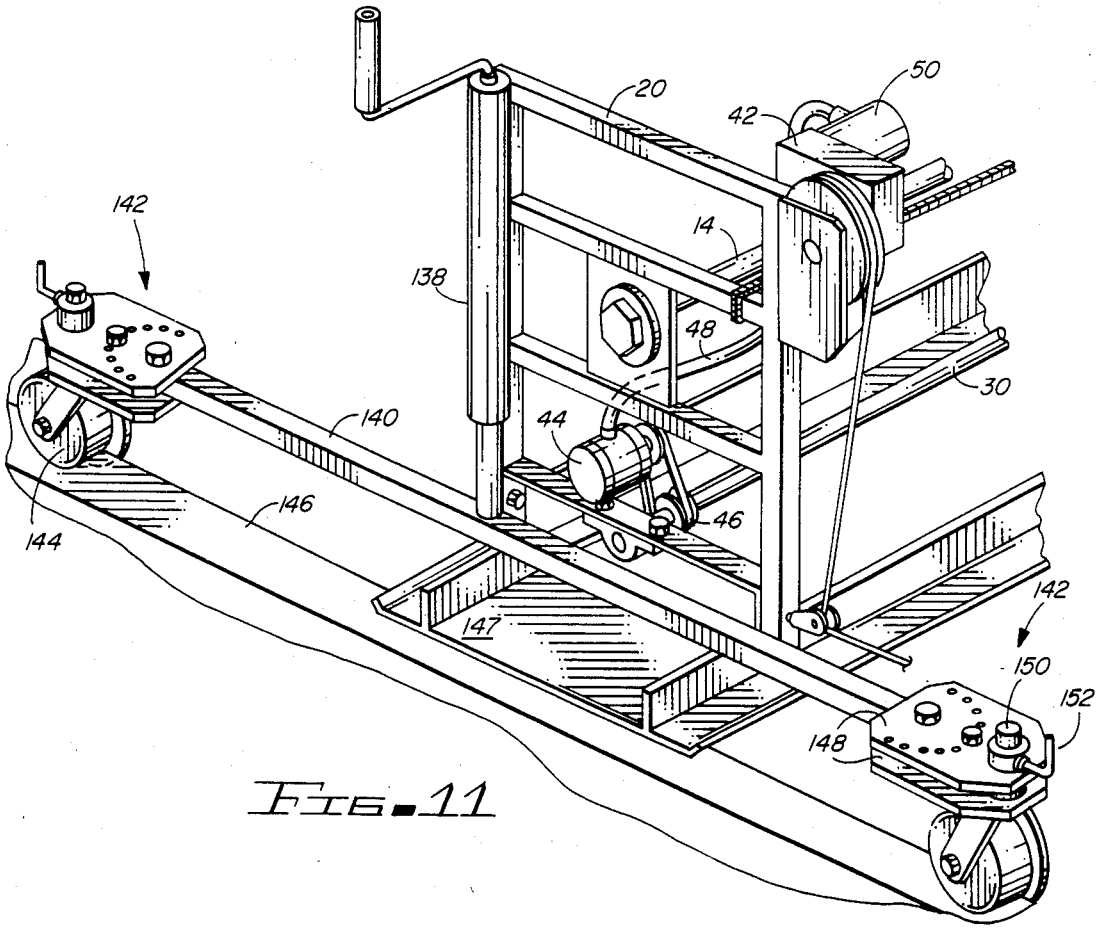
Figure 13:
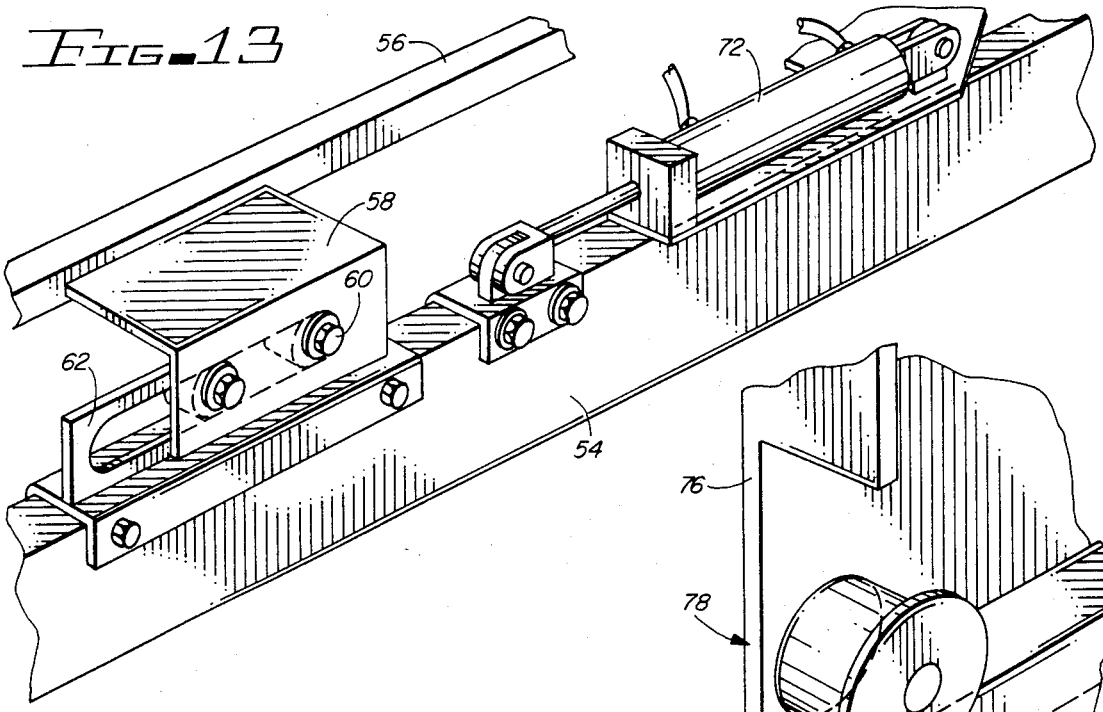
Figure 14:
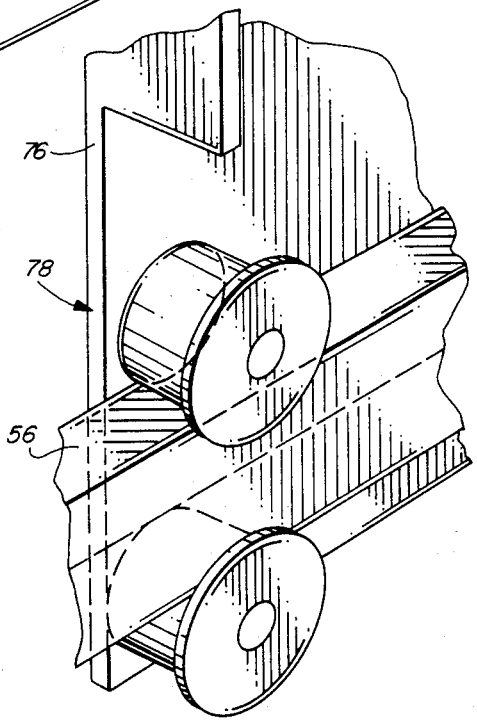
Figure 15A:
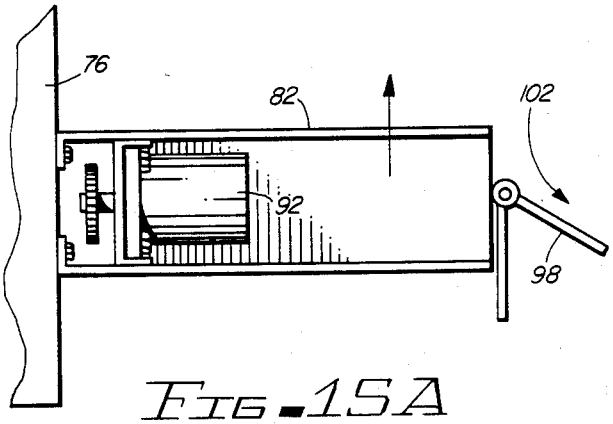
Figure 15B:
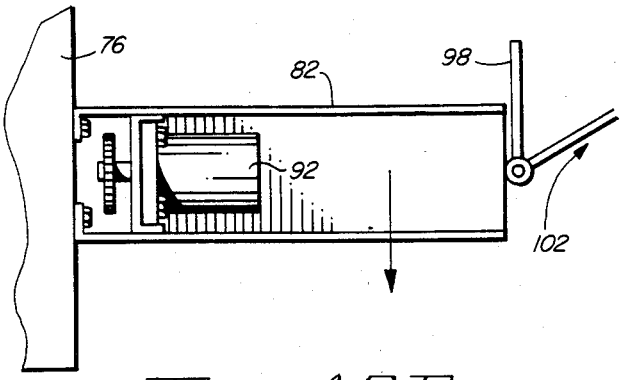
Figure 16:
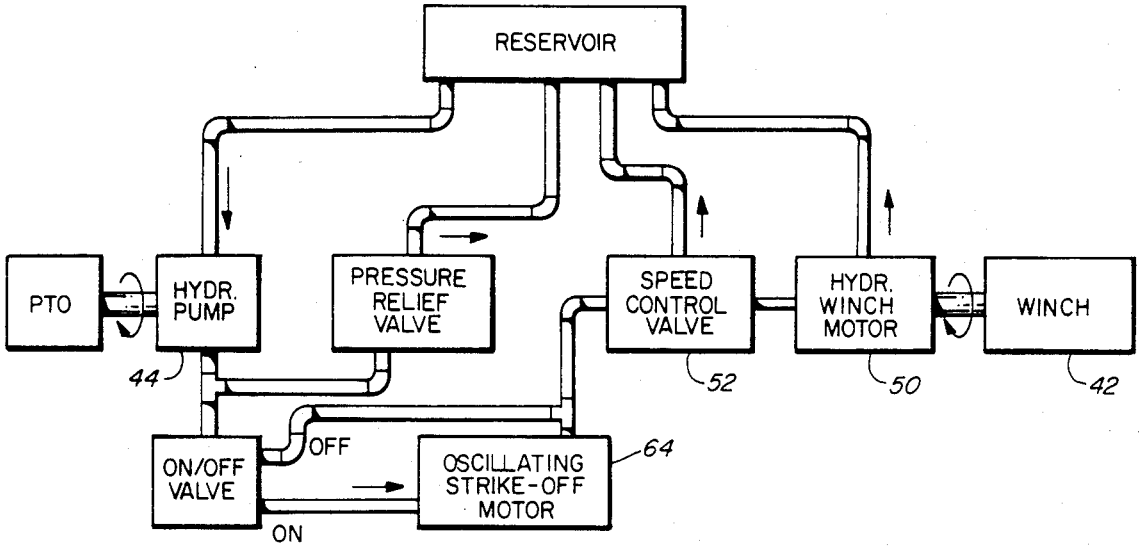

Continuous, reciprocating motion of the oscillating strike-off 330 is provided by reciprocating means in the form of a dual-action pneumatic ram 356 and the associated connecting linkage 358 depicted in FIG. 38. As illustrated in FIG. 4 of U.S. Pat. No. 4,466,757, oscillating strike-off 330 may also be driven by reciprocating means in the form of hydraulic motor 64 and the associated reciprocation linkage depicted.

When the oscillating strike-off 330 is operated without the concrete spreading means of the present invention as depicted in FIG. 38, single or dual paired air vibrators 334 may be coupled as shown to vibrate the blade of the oscillating strike-off. When the oscillating strike-off 330 is configured as indicated in FIG. 37 and positioned between the trailing edge of plow 306 and screed blade 16, the air vibrators 334 will typically be removed to minimize the space occupied by strike-off 330.

Figure 41:
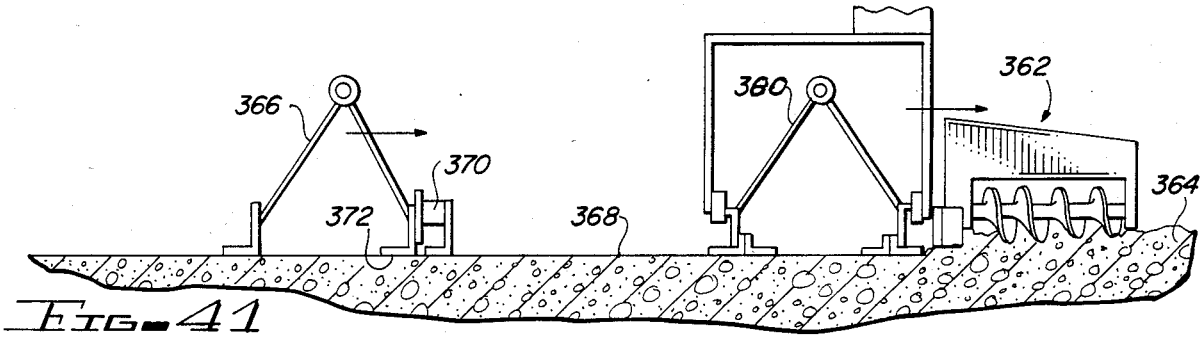
FIG. 41 depicts a paver train comprising a primary finishing screed including concrete spreading means followed in spaced apart relationship by a secondary finishing screed including an oscillating strike-off system.
Figure 42:
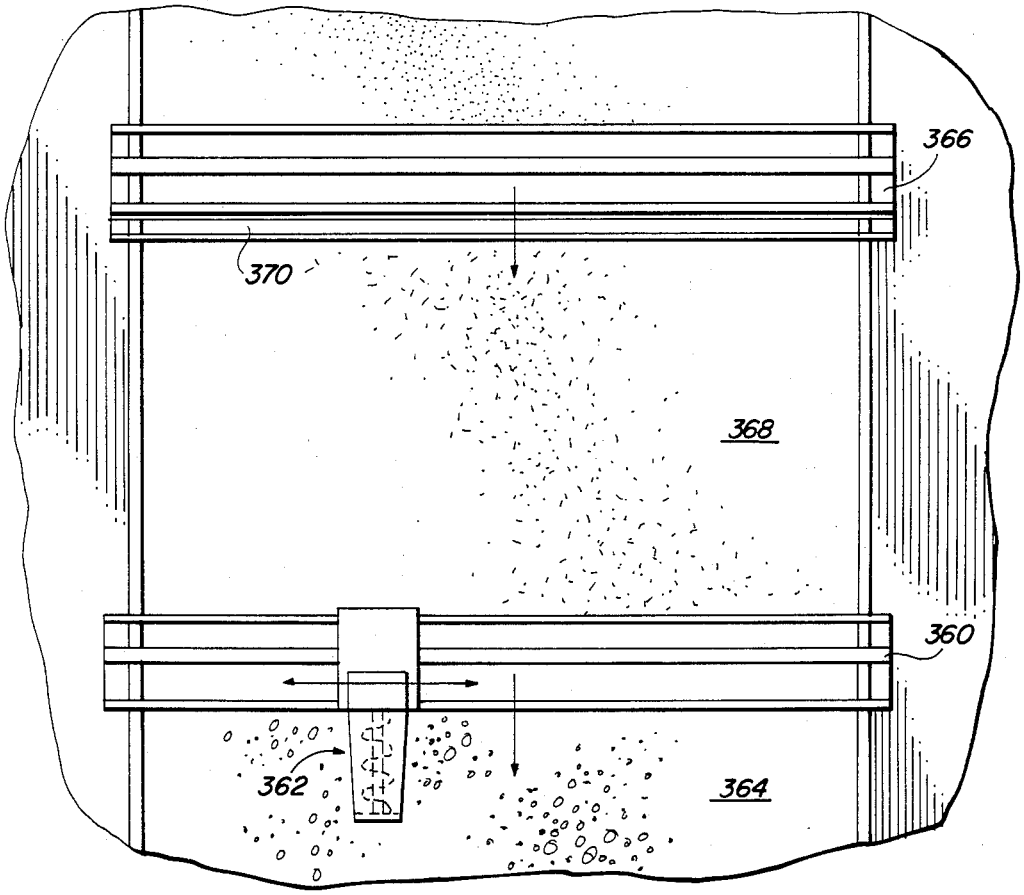
FIG. 42 represents a view from above of the paver train depicted in FIG. 41.

Referring now to FIGS. 41 and 42, a paving train consisting of a primary finishing screed 360 and a secondary finishing screed 366. Screed 360 includes concrete spreading means 362 while screed 366 includes oscillating strike-off 370. Screed 366 trails screed 360 by a predetermined time or distance to allow the partially finished concrete existing screed 360 to reach a semi-equilibrium condition prior to engagement by screed 366. Screed to screed spacing on the order of twenty to forty feet is typical although other spacing variations would be apparent to one of ordinary skill in the art.

It has been found that use of the disclosed two-unit paving train incorporating primary and secondary screeds including concrete spreading means 362 and oscillating strike-off 370 produces a superior concrete finish. Since screeds 360 and 366 typically include precisely controllable, hydraulically actuated winches, the screed translation velocity and screed to screed spacing can easily be regulated.

It will be apparent to those skilled in the art that the disclosed vibratory concrete screed and paver train system may be modified in numerous ways and may assume many embodiments other than the preferred forms specifically set out and described above. For example, various different plow configurations other than the disclosed configuration would function effectively as metering means. Distributing means such as a V-shaped grading blade or a spinning tube finisher could be used as a substitute for the disclosed rotating auger distributing means. Accordingly, it is intended by the appended claims to cover all such modifications of the invention which fall within the true spirit and scope of the invention.

I claim:

1. A vibratory concrete screed for finishing the surface of an area of unfinished plastic concrete lying between first and second spaced apart, generally parallel forms, the spacing between the first and second forms defining the width of the plastic concrete, said screed comprising:

a. a frame having first and second ends with a length equal to or greater than the width of the plastic concrete;

b. a screed blade coupled to said frame and including a substantially horizontal blade surface and a leading edge;

c. means coupled to said frame for advancing said screed along the length of said forms into the unfinished plastic concrete;

d. means for vibrating said screed blade; and e. concrete spreading means coupled to said screed for partially levelling the unfinished plastic concrete and for regulating the charge height of the concrete intercepted by the leading edge of said screed blade, including i. an auger having a longitudinal axis, a leading edge and a trailing edge;

ii. carriage means for maintaining said auger at a predetermined elevation in front of said screed blade with the longitudinal axis of said auger inclined at an angle to said screed blade with the leading edge of said auger extending outward from said screed blade and in front of the trailing edge of said auger, for translating said auger in either a first or a second direction along said screed frame, and for rotating said auguer to laterally redistribute said plastic concrete, to displace said concrete forward and away from said screed blade and to thereby form an intermediate, partially levelled concrete surface; and iii. metering means coupled to said carriage means to maintain a gap between said metering means and said screed blade, said metering means having a lower surface maintained below the intermediate concrete surface formed by said auger and above the horizontal blade surface of said screed blade for regulating the charge height of plastic concrete fed to the leading edge of said screed blade and for moving excess height plastic concrete forward into the rotating trailing edge of said auger where said excess height concrete is intercepted and displaced forward toward the leading edge of said auger and away from said metering means and is laterally redistributed by said auger as said carriage means translates said metering means and said auger in first and second directions along the length of said screed frame.

2. The screed of claim 1 wherein the longitudinal axis of said auger is oriented substantially perpendicular to the lengthwise axis of said screed frame.

3. The screed of claim 2 wherein said metering means is centered about the longitudinal axis of said auger and includes a lower rear edge oriented parallel to the leading edge of said screed blade.

4. The screed of claim 3 wherein said metering means includes a flat, horizontally oriented lower surface.

5. The screed of claim 4 wherein said metering means includes first and second symmetrical end sections extending laterlly outward beyond said auger, wherein each end section includes a wedge having a cutting tip including a vertical edge oriented perpendicular to the longitudinal axis of said auger.

6. The screed of claim 3 wherein said concrete spreading means further includes first means for adjusting the vertical spacing between said metering means and the horizontal surface of said screed blade to control the charge height of the concrete discharged from said metering means and intercepted by said screed blade.

7. The screed of claim 6 wherein said concrete spreading means further includes second means for adjusting the vertical spacing between said auger and the horizontal surface of said screed blade.

8. The screed of claim 3 wherein said concrete spreading means further includes means for simultaneously adjusting the vertical spacing between the horizontal surface of said screed blade and both said auger and said metering means.

9. The screed of claim 1 further including an oscillating strike-off coupled to said screed between said concrete spreading means and said screed blade for smoothing and compacting the plastic concrete discharged from said metering means before engagement by said screed blade wherein said oscillating strike-off includes a lower surface positioned at an elevation above the elevation of the horizontal blade surface of said screed blade and below the level of plastic concrete discharged from said metering means.

10. The screed of claim 9 further including means for reciprocating said oscillating strike-off with respect to said screed blade.

* * * * *